United States Patent [19]

Hsieh

[11] Patent Number: 4,531,806

[45] Date of Patent: Jul. 30, 1985

[54] FUSIBLE ELECTRICAL CONNECTOR

[75] Inventor: Shao-Chung Hsieh, Warren, Ohio

[73] Assignee: General Motors Corporation, Detroit, Mich.

[21] Appl. No.: 555,051

[22] Filed: Nov. 25, 1983

[51] Int. Cl.[3] ..... H01R 3/00; H01H 85/04

[52] U.S. Cl. ..... 339/147 R; 337/188; 337/290; 339/198 R; 339/210 R

[58] Field of Search ..... 337/180, 181, 188, 233, 337/290, 295; 339/147 R, 147 P, 198 R, 210 R, 210 M, 220 R

[56] References Cited

U.S. PATENT DOCUMENTS

| | | | |
|---|---|---|---|
| 2,259,053 | 10/1941 | Xenis | 337/188 |
| 2,282,279 | 5/1942 | Xenis | 337/295 |
| 2,354,134 | 7/1944 | Ludwig et al. | 337/295 |
| 2,560,138 | 7/1951 | Swain | 337/233 |
| 3,369,212 | 2/1968 | Coldren et al. | 339/220 R |
| 3,492,628 | 1/1970 | Matthews | 339/220 R |
| 4,199,214 | 4/1980 | Pearce, Jr. et al. | 339/147 P |
| 4,218,109 | 8/1980 | Kneusels | 339/147 R |
| 4,280,748 | 7/1981 | McHenney et al. | 339/147 R |
| 4,410,226 | 10/1983 | Adduci et al. | 339/198 J |
| 4,443,047 | 4/1984 | Hofmann | 339/210 R |

FOREIGN PATENT DOCUMENTS 1488404 4/1969 Fed. Rep. of Germany .

OTHER PUBLICATIONS

Honda Fuse Assembly, 55A.

*Primary Examiner*—Gil Weidenfeld
*Assistant Examiner*—Gary F. Paumen
*Attorney, Agent, or Firm*—F. J. Fodale

[57] ABSTRACT

A fusible electrical connector assembly comprises a sheet metal terminal of one-piece construction having an intermediate fuse portion and a housing having a fuse chamber in which the intermediate fuse portion of the terminal is disposed. The fuse chamber is defined in part by spaced slotted walls. The terminal has conformations which cooperate with the respective slotted walls to retain the terminal parts in assembly with the housing when the intermediate fuse portion has "blown" and to maintain a spacing between the ends of the fuse portion remnants.

7 Claims, 5 Drawing Figures

FUSIBLE ELECTRICAL CONNECTOR

This invention relates to fusible electrical connectors and, more particularly, to such connectors comprising a sheet metal terminal of one-piece construction which is attached to the end of a cable and which includes a fuse element as an integral part of the terminal.

U.S. Pat. No. 4,199,214 granted to Warren Pearce, Jr. and Charles W. Ramsey on Apr. 22, 1980 discloses a sheet metal terminal of the above-noted type.

The object of this invention is to provide an improved fusible connector which is more compact and which has the fuse element housed to contain any flash which might occur when the fuse element blows.

A feature of the invention is that the terminal has a conventional crimp barrel comprising contiguous serially arranged core and insulation crimp wings for attaching the terminal to the end of a cable in a conventional manner.

Another feature of the invention is that the terminal has conformations which locate the fuse element properly in the housing.

Another feature of the invention is that the terminal has other conformations which cooperate with the aforementioned conformations and the housing to retain the two terminal parts in assembly with the housing after the fuse has blown.

Another feature of the invention is that these conformations provide two way retention so that the ends of the blown fuse element are maintained in a spaced relationship to prevent current flow after the fuse element has blown.

Other objects and features of the invention will become apparent to those skilled in the art as the disclosure is made in the following detailed description of a preferred embodiment of the invention as illustrated in the accompanying sheet of drawing in which.

Figure 1:
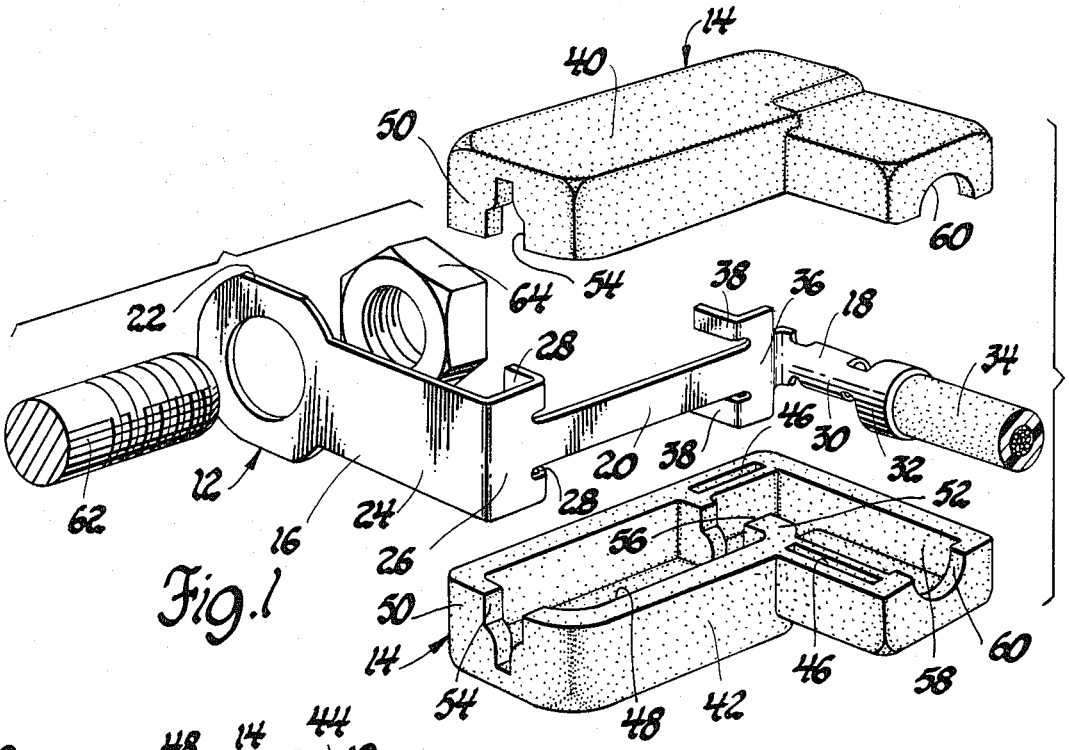
FIG. 1 is an exploded perspective view of a fusible electrical connector is accordance with the invention.

Referring now to the drawing, the fusible electrical connector 10 of the invention comprises a stamped and bent, sheet metal terminal 12 of one-piece construction and a two-piece dielectric housing 14.

The terminal 12 has a contact end portion 16, a cable attachment end portion 18 and an intermediate fuse portion 20 which is the sole terminal portion connecting the end portions 16 and 18 to each other.

The contact portion 16 comprises a ring contact 22 at the end of a strap 24. The inner end of the strap 24 is bent at a right angle to form a bridge 26 which is coplanar with the fuse portion 20 and which attaches the strap 24 to one end of the fuse portion 20.

The inner end of the bridge 26 has two upright locator tabs 28 which are on opposite sides of the fuse portion 20 and which are spaced from the strap 24 in the longitudinal direction to provide a two-way retention of the contact end portion 16 with the housing 14 when the fuse portion 20 is "blown" as will hereinafter more fully appear.

Figure 2:
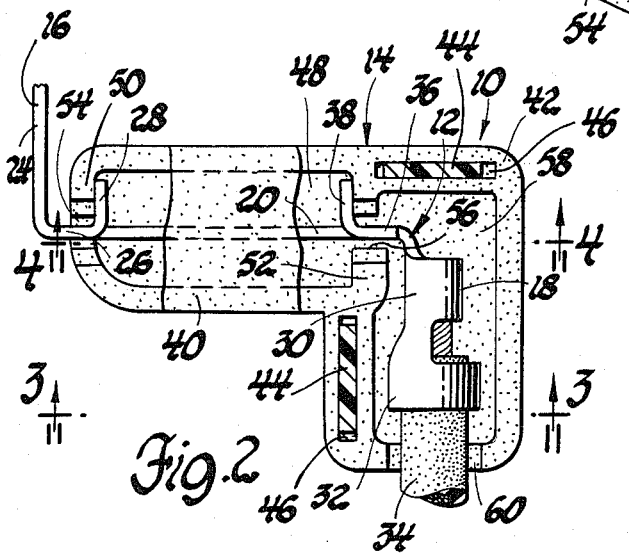
FIG. 2 is a partially sectioned side view of the fusible electrical connector shown in FIG. 1.
Figure 3:
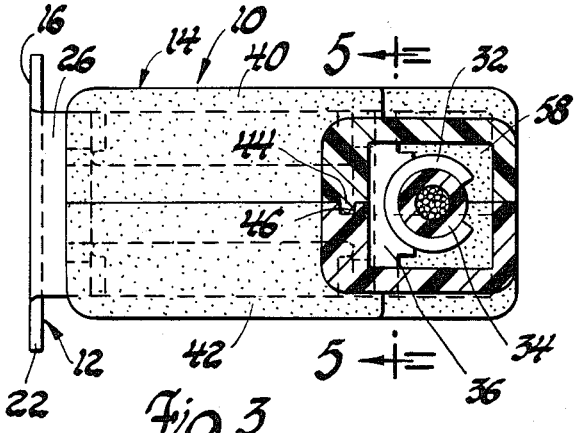
FIG. 3 is a section taken substantially along the line 3—3 of FIG. 2 looking in the direction of the arrows.

The cable attachment portion 18 includes a conventional crimp barrel comprising contiguous, serially arranged core and cable crimp wings 30,32 which are crimped to the conductive core and insulation jacket of a cable 34 in a conventional manner as shown in FIGS. 1, 2 and 3. The inner end of the cable attachment portion 18 is also bent at a right angle with respect to the crimp barrel to form a coplanar bridge 36 at the opposite end of the fuse portion 20. The inner end of this bridge 36 also has two upright locator tabs 38. The tabs 38 are on the opposite sides of the fuse portion 20 and spaced from the crimp wings 30,32 in the longitudinal direction to provide a two-way retention with the housing 14 when the fuse portion 20 is blown as will hereinafter more fully appear.

Figure 4:
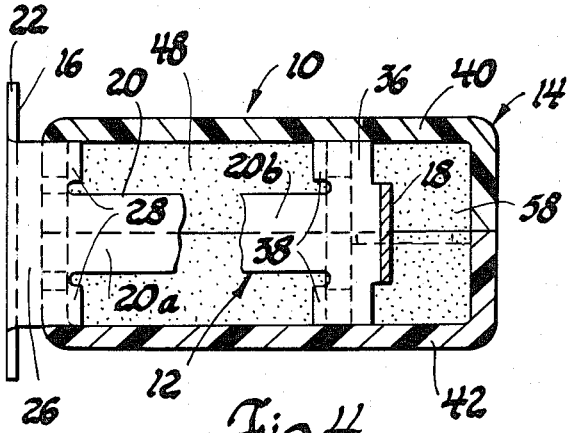
FIG. 4 is a section taken substantially along the line 4—4 of FIG. 2 looking in the direction of the arrows and illustrating a "blown" condition.
Figure 5:
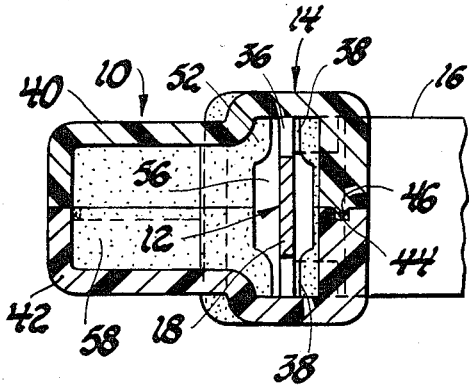
FIG. 5 is a section taken substantially along the line 5—5 of FIG. 3 looking in the direction of the arrows.

The fuse portion 20 is flat and rectangular in cross-section being of constant width and thickness throughout its length. The cross-section of the fuse portion 20 is specifically chosen and defines the current capacity of the sheet metal terminal 12 and, consequently, that of the fusible electrical connector 10. When the current capacity is exceeded, the fuse portion 20 melts, breaking the electrical connection between the contact end portion 16 and the cable end portion 18. The fuse portion 20 does not melt completely and remnants 20*a* and 20*b* are attached to the end portions 16 and 18, respectively, as shown in FIG. 4.

The two-piece housing 14 comprises longitudinal male and female sections 40 and 42 of L-shaped configuration which are essentially mirror images of each other. The male housing section 40, however, has tenon portions 44 which fit into mortise portions 46 of the female housing section 42 and assist in securing the housing sections to each other.

The two-piece housing 14 formed by the sections 40 and 42 has a longitudinal fuse chamber 48 defined in part by transverse walls 50 and 52 at its opposite ends. Slot-like openings 54 and 56 extend through the transverse walls 50 and 52, respectively. The two-piece housing 14 also has a transverse chamber 58 which houses the crimp barrel of the attachment end portion 18 and which communicates with the fuse chamber 48 via the slot opening 56 through the wall 52. The chamber 58 has a round outlet 60 for the cable 36.

The connector 10 is assembled by inserting the terminal 12 laterally into either the male or the female housing section 40 or 42, with the locator tabs 28 and 38 on one side of the fuse element 20 serving to properly locate the fuse portion 20 in the cavity which forms half of the fuse chamber 48 when the housing sections are mated. After the terminal 12 is laterally inserted, the housing sections 40 and 42 are fitted together around the terminal 12 with the assistance of the locator tabs 28 and 38 of the terminal on the opposite side of the fuse element 20 and the tenons 44 and mortises 46 of the housing sections. The housing sections 40 and 42 are then friction welded together to complete the assembly of the fusible electrical connector 10 at the end of the cable 36. The connector 10 is then simply attached to any stud terminal 62 by a nut 64 which clamps the ring contact 22 at the end of the protruding strap 24. A ring contact 22 has been illustrated because it is the most common type employed, however, other contact shapes are also within the scope of the invention.

In the completed assembly, the fuse portion 20 is housed in the fuse chamber 48 and located longitudinally therein by the four upright tabs 28 and 38. The fuse portion 20 is located in both transverse directions, that is, vertically and laterally, primarily by the bridge portions 26 and 36 in cooperation with the respective slot openings 54 and 56 at the opposite ends of the fuse chamber 48.

When the fuse portion 20 "blows" because of an excessive electric current, any accompanying flash is contained in the fuse chamber 48. After the fuse portion has "blown", the contact end portion 16 of the terminal and the fuse remnant 20*a* attached thereto are retained in assembly with the housing 14 by the strap 24 and the locator tabs 28 which are located on opposite sides of the wall 50 which provides a two-way retention. This two-way retention prevents the contact end portion 16 from falling into the fuse chamber 48 as well as separating from the housing 14.

Similarly, the cable attachment end portion 18 and the fuse remnant 20*b* attached thereto are retained by the tabs 38 and the crimp barrel comprising crimp wings 30 and 32 which are located on the opposite sides of the wall 52 which provides a two-way retention.

The two-way retention at each end of the fuse chamber 48 not only prevents separation of the terminal parts from the housing 14 but also maintains a spacing between the ends of the fuse remnants 20*a* and 20*b* so that contact and current flow is prevented after the fuse has "blown".

The transverse chamber which insulates the crimp barrel of the attachment end portion 18 also traps the crimp barrel and provides additional assurance that the attachment end portion 18 does not separate from the housing 14 after the fuse has "blown".

The terminal 16, which is illustrated, is generally Z-shaped. However, other shapes are possible. For instance, either the contact end portion 16 or the attachment end portion 18 or both could be aligned with the fuse portion 20 in the longitudinal direction resulting in a terminal which is generally L-shaped or strip-shaped. In any event, the two-way retention at each end wall of the fuse chamber is necessary and, consequently, if the shape is changed, conformations will have to be provided if the strap 24 or the crimp barrel cannot provide such a feature.

I wish it to be understood that I do not desire to be limited to the exact details of construction shown and described, for obvious modifications will occur to a person skilled in the art.

The embodiments of the invention in which an exclusive property or privileged is claimed are defined as follows:

1. A fusible electrical connector assembly comprising a sheet metal terminal of one-piece construction having a contact end portion, a cable attachment end portion and an intermediate fuse portion which is the sole terminal portion connecting the contact end portion to the cable attachment end portion, and a housing having a fuse chamber in which the intermediate fuse portion of the terminal is disposed, said chamber in part being defined by first and second spaced walls of the housing, each of which has a slot opening extending therethrough, said contact end portion of the terminal extending into the chamber through the slot opening in said first wall and having conformations on the opposite sides of said first wall, said cable attachment portion extending into said chamber through the opening in said second wall and having conformations on the opposite sides of said second wall, and said conformations of the end portions of the terminal cooperating with the respective spaced walls to retain the respective end portions of the terminal in assembly with the housing upon failure of the intermediate fuse portion due to an excessive electric current.

2. A fusible electrical connector assembly comprising a sheet metal terminal of one-piece construction having a contact end portion, a cable attachment end portion comprising a crimp barrel and an intermediate fuse portion which is the sole terminal portion connecting the contact end portion to the cable attachment end portion, and a housing having a longitudinal fuse chamber in which the intermediate fuse portion of the terminal is disposed, said chamber in part being defined by first and second spaced walls of the housing, each of which has a slot opening extending therethrough, said contact end portion of the terminal having a bridge portion extending into the fuse chamber through the slot opening in said first wall and upright tabs at the end of the bridge portion disposed inside the fuse chamber, said cable attachment portion having a bridge portion extending into said fuse chamber through the slot opening in said second wall and upright tabs at the end of the bridge portion disposed inside the fuse chamber, said tabs cooperating with said first and second walls to locate said fuse portion longitudinally in said fuse chamber, said contact end portion having a conformation on the opposite side of said first wall from the upright tabs at the end of its bridge portion to provide two-way retention of the contact end portion with the housing upon failure of the intermediate fuse portion due to an excessive electric current, and said cable attachment end portion having a conformation on the opposite side of the second wall from the upright tabs at the end of its bridge portion to provide two-way retention of the cable attachment end portion upon failure of the intermediate fuse portion.

3. The fusible electrical connector as defined in claim 2 wherein the tabs and conformations of the end portions cooperate with the first and second walls to maintain a spacing between the ends of the remnants of the fuse portion upon failure thereof to prevent contact and current flow after the fuse portion has blown.

4. The fusible electrical connector as defined in claim 2 wherein the bridge portion of the contact end portion is a bent end of a strap and the strap is the conformation of the contact end portion.

5. The fusible electrical connector as defined in claim 2 wherein the crimp barrel is the conformation of the cable attachment end portion.

6. The fusible electrical connector as defined in claim 2 wherein the contact end portion includes a strap which provides the conformation and a bent end of the strap which provides the bridge portion thereof and wherein the crimp barrel of the attachment end portion is perpendicular to the bridge portion thereof to provide the conformation of the attachment end portion.

7. The fusible electrical connector as defined in claim 2 wherein the housing includes a second chamber which communicates with the fuse chamber through the slot opening in the second wall and wherein the crimp barrel is disposed in the second chamber.

* * * * *